United States Patent [19]

Györy

[11] 4,134,156

[45] Jan. 16, 1979

[54] SAFETY HELMET

[76] Inventor: Kalman Györy, Ahrwaldstr. 7, 3141 Garlstorf a. Walde, Germany

[21] Appl. No.: 801,914

[22] Filed: May 31, 1977

Related U.S. Application Data

[63] Continuation-in-part of Ser. No. 695,115, Jun. 11, 1976, Pat. No. 4,038,700.

[30] Foreign Application Priority Data

Dec. 29, 1976 [DE] Fed. Rep. of Germany ..... 2659324

[51] Int. Cl.[2] ..... A42B 3/02

[52] U.S. Cl. ..... 2/413

[58] Field of Search ..... 2/413, 414, 410, 411, 2/425, 10, 423

[56] References Cited

U.S. PATENT DOCUMENTS

| | | | |
|---|---|---|---|
| 3,186,004 | 6/1965 | Carlini | 2/413 |
| 4,023,213 | 5/1977 | Rovani | 2/413 |

FOREIGN PATENT DOCUMENTS

| | | | |
|---|---|---|---|
| 2285823 | 4/1976 | France | 2/414 |
| 1402287 | 8/1975 | United Kingdom | 2/411 |

*Primary Examiner*—Louis Rimrodt
*Attorney, Agent, or Firm*—Fleit & Jacobson

[57] ABSTRACT

A safety helmet comprising an inflatable, interconnected air-cushion system wherein the air-cushion system is positioned in the lower part of an integral helmet. The integral helmet has a tapered portion extending in a downward direction below the chin of the wearer, and has a frontal opening for the face. The air cushion system is positioned within a pocket in the helmet and extends from the lower edge of said helmet to at least the level of the ears, but not higher than the level of the temples of a wearer of the safety helmet. The air-cushion system comprises a continuous band of two flexible foils, and means for interconnecting said foils in an air-tight manner, preferably comprising cross-pieces extending between the foils in such a way that the foils and the cross-pieces form two inflatable cheek cushions and one inflatable neck-cushion. Connecting passageways between the cheek cushions and the neck cushion are provided, and throttling passageways are positioned between the non-inflatable areas and the inflatable areas.

16 Claims, 5 Drawing Figures

SAFETY HELMET

This is a continuation-in-part of Ser. No. 695,115, filed June 11, 1976, now U.S. Pat. No. 4,038,700.

BACKGROUND AND SUMMARY OF THE INVENTION

The present invention is concerned with a safety helmet for motor-cyclists that satisfies the special demands made upon this type of head gear, to an extent never achieved before. Simple helmets have been in general use for a long time, and consist essentially of a hard shell covering the cranium and the temples reaching just above eye level, and have a soft padding. These simple helmets may be used, in practically the same design for a wide range of purposes, as crash helmets, safety helmets, workmen's "hard hats", etc. There have also been developed a number of special helmets for particular purposes, such as helmets for hockey, football or rugby players, auto racing drivers, and aviators, to cite just a few examples. All of these special helmets must meet the particular requirements essential only for their particular intended use. For example, a special feature of football and rugby helmets is that they must leave the face of the player free as much as possible in order to afford him the widest possible field of vision, as well as to show his face to the spectators. Less important in such cases is the considerable time required to put on and fit the helmet.

The following features satisfy some of the special requirements of safety helmets for motor-cyclists that are not required of any other type of protective head gear. First of all, no other kind of helmet is exposed to wind velocities of anywhere near the same magnitude. Similarly, the wearer of the helmet faces great danger in case of an accident, due to the high speeds. On the other hand, the wearer does not require an equally wide field of vision extending to nearly 360°, as does a rugby player. For these reasons, it is expedient and warranted to encase the head of the wearer, including the full face plus the mouth, nose, cheeks, and chin, in a helmet that is padded all over and in which only a frontal opening for the face has been left, this opening being formed by a transparent visor. Protective helmets of the type that encase the entire head and extend downward so as to cover the chin, are known as "integral helmets" and are gaining increased acceptance because of their excellent protective features even in very serious accidents against which other helmets do not offer any protection, or only minimal protection, although there does exist certain considerable drawbacks to these helmets.

These disadvantages have largely to do with the aforementioned high travel speeds to which a helmet and its wearer may be exposed. The velocities tend to make the helmet slip out of place if it is not made to fit the head of the wearer very exactly and tightly, thereby causing discomfort to the wearer. Heretofore it has not been fully possible, because of technical and commercial reasons, to meet this requirement of a close fit of the wearers' head not only with respect to size, but also shape. A product of such general use would be uneconomical to keep in stock, since it requires a complete line of head sizes and at least four different head shapes ranging from angular and broad to slim and oval.

An even greater disadvantage arising from the requirement of a perfect fit of an integral helmet lies in the fact that a helmet that meets this requirement completely can only be put on and taken off by overcoming the resistance of the elastic padding, since the helmet tapers off downwardly and forwardly to conform to the anatomy of the human head. While this presents a minor problem for healthy uninjured persons, it becomes quite difficult in the case of neck injuries that are unavoidable even with the best protective helmet. In such cases, it is highly important that the helmet be lifted off the head of an injured person as carefully as possible, and this cannot be done with the known integral helmets for the aforementioned reasons. This difficulty is so serious that for some time, all ambulances have been equipped with bone saws, not because it is necessary to saw off a bone at the scene of an accident, but solely for the purpose to remove, where necessary, an integral helmet from the head of the accident victim without injury to him. Obviously, the task of removing the helmet cannot be left to laymen, nor even to highly skilled persons, including doctors, if they are not provided with the necessary special saws. As a result, valuable time may be lost in many cases before the medical care of an accident victim can be initiated.

The present invention is concerned with a motor-cycle helmet that has all the advantages of the known integral helmets, namely their excellent protection in case of an accident, but avoids all of the drawbacks that have not been overcome so far. Thus, the motor-cycle helmet in accordance with the invention makes possible an exact fitting of the head size of the wearer as well as its shape, requiring a considerably smaller number of helmets to be kept in stock, and facilitating an easy and gentle removal, never achieved before, from the head of the wearer. Even in the case of serious injuries to the spine, any further harm to the victim due to the removal of the helmet is positively prevented.

The advantages in accordance with the invention are achieved by designing a protective helmet, generally familiar, to enclose the entire head of the wearer, including his face, and extending downward below the lower edge of the chin, and provided with a visor type of opening for the face that tapers off downwardly. The inside of the helmet is padded using a system, the principle of which is known as such in other contexts, of inflatable air-cushions that are inter-connected by throttling passage-ways. This system differs in many respects from the known systems of air-cushions with inter-connected throttling passage-ways in design, in the manner of its fastening to the helmet, and also by its interaction with other padding features of the helmet.

An essential characteristic of the invention lies in the fact that, while the air-cushion system encloses and protects the neck and cheeks of the wearer, it leaves free the top of the skull, in contrast to all known safety helmets that use inflatable air-cushions, and assigns the protection of the cranium entirely to a familiar padding with an elastic material such as styropor and/or foam rubber. This does not impair the protection in the area of the cranium, but offers the special advantage of eliminating undesirable and often unavoidable upward pull on the chin-strap.

Another advantage achieved by omitting air-cushions above the cranium consists in avoiding the recoil effect that occurs after the end part of an impact due to the re-expansion of the air-cushion.

In accordance with this invention, the air cushions are arranged in the helmet in such a way that they extend from the lower edge of the cheek-bones to the uppermost tip of the ears, but not as far as the temple.

Preferably, the air-cushion system with throttling passage-ways between the various air-cushions, is designed as a continuous band made up of two foils, which are superimposed and inter-connected in a gas-tight manner. Similarly, in accordance with another preferred embodiment of the invention, cross-pieces, likewise made of elastic gas-tight material may be mounted on the upper, lower and lateral edges. This latter embodiment of the invention has the advantage, compared to the simpler embodiment, that the air-cushion will not bulge forward when inflated, and thereby exert an undesirable pressure. The width of these cross-pieces should amount to not less than half the difference between the inside diameter of the helmet and the diameter of the smallest head-size to be fitted, and not greater than three times the amount of that difference.

A preferred design of the air-cushion system consists of a double-walled gas-tight band with perhaps elastic crosspieces between the walls, and containing, in the cervical region and in the two regions of the cheeks, inflatable air-cushions. Between the inflatable air cushions are two non-inflatable parts of the band. The non-inflatable parts of the band have passageways leading to the adjoining inflatable cushion parts. In addition, throttling passage-ways are provided between each air cushion and its adjoining non-inflatable section, said throttling passage-ways affording a pressure balance between the various aircushions, but also retarding the air from the air cushions. The intensity of the retarding effect must be regulated rather carefully. If it is too weak, the air-cushion system does not develop sufficient elasticity and thus does not provide sufficient protection; if it is too strong, the fitting of the helmet to the size and shape of the head of the wearer is impaired.

An ideal throttling effect that is neither too weak nor too strong can be achieved in accordance with a preferred embodiment of the invention by affixing labyrinth joints to the throttling passage-ways. These labyrinth joints can be made most effectively by using some, preferably not more than two, welded or adhesive seams that are staggered and placed adjacent to each other.

Advantageously, the lateral, or cheek, cushions of the system extend no farther forward than to the sides of the chin, while the chin region of the helmet is lined with a familiar non-inflatable pliable cushioning material, for instance styropor or foam rubber. In this way, any undesirable horizontal pull during inflation of the cushion-system is avoided. The same purpose is served by designing an air-cushion that protects the neck, e.g., by installing some welded joints so that it will be inflated less than the cheek cushions, when the system is inflated.

It is also advantageous to have the neck support consist not of an inflatable air-cushion, but of elastic foam material, in the conventional manner.

The fastening of the air-cushion system within the helmet may be done advantageously by placing it inside a pocket that is firmly attached to the helmet and preferably, by fastening the air-cushion system to the pocket firmly, but so as to be detachable by means of snap fasteners.

BRIEF DESCRIPTION OF THE DRAWINGS

A preferred embodiment of the invention shall be explained in greater detail, schematically and by way of example, on the basis of the drawings.

DETAILED DESCRIPTION OF THE DRAWINGS

Figure 1:
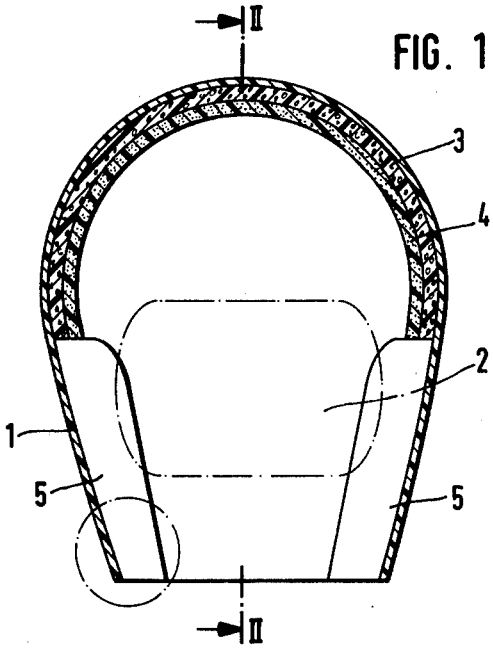
FIG. 1 is a view of a vertical section along the line 1—1 of FIG. 2. In this section, the facial opening 2, located in front of the plane of the section has been drawn for the sake of clarity.
Figure 3:
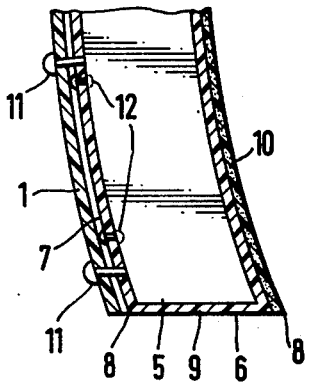
FIG. 3 is an enlargement of the circular area of FIG. 1.

In the Figures, 1 designates the shell of the helmet, 3 is the styropor padding of the upper part of the helmet, positioned above the air-cushion padding that is inserted in accordance with the invention, 4 denotes an additional padding that is made, e.g., of PVC-foam-coated tissue, or layer, that extends not altogether up to the roof of the skull, and that is applied above the styropor, and 5 designates the continuous system of inflatable air-cushions that is inter-connected by way of throttling passage-ways and is located in the pocket 6. The pocket 6, as shown in FIG. 3, consists, for example, of a rigid, but sufficiently flexible hard-PVC- foil 7, forming the rear wall of the pocket that is joined, by way of a seam 8, to a connecting piece 9, and to a front wall 10. The front wall 10 of the pocket, consists, for example, of tissue coated with foam material on the inside.

The pocket 6 is solidly and firmly attached to the shell 1 of the helmet, e.g., by means of rivets 11. A solid, fixedly, but advantageously detachably, connection between the air-cushion padding 5 and the pocket 6 can be provided, by means of snap-fastener connections 12.

Figure 2:
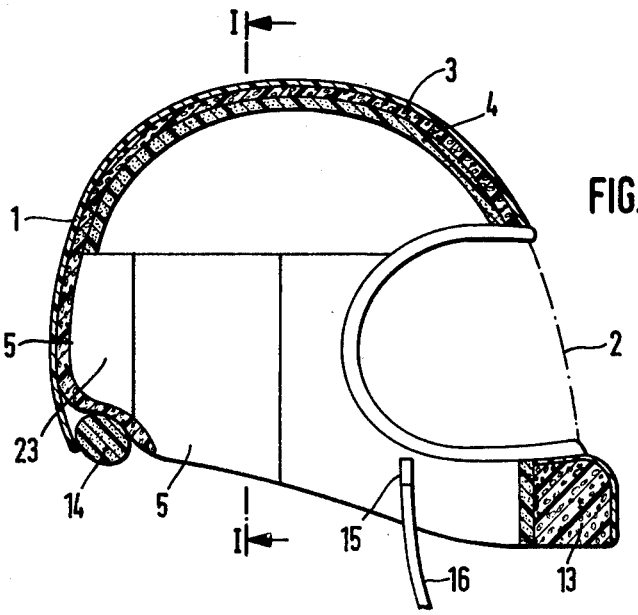
FIG. 2 is a vertical section along the II—II of FIG. 1.

As may be seen in FIG. 2, the air-cushion padding 5 extends only to a point on the helmet corresponding to the sides of the chin, while the chin region of the helmet is padded with another material, e.g., with foam-rubber coated styropor 13. The air-cushion padding 5 extends to a point slightly below where the helmet side portions start to curve toward each other. The neck support 14 also has been developed in a conventional way, viz., not as an air cushion but instead is made of a foam material. 15 is the fastening device of the chin strap 16.

Figure 4:
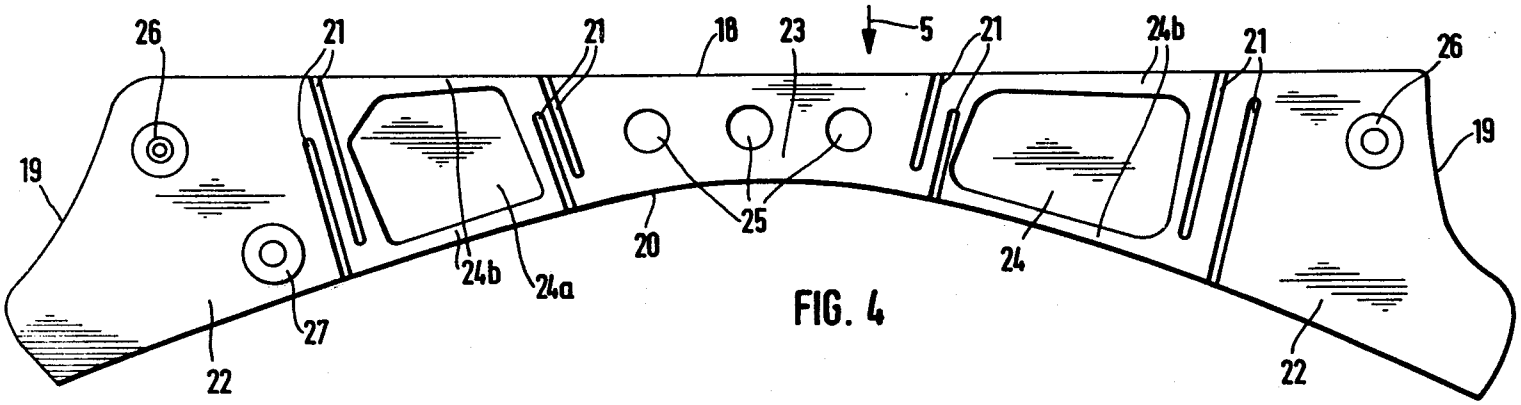
FIG. 4 is a view of the system preferably designed as a band, of air-cushions that are inter-connected by throttling passageways, shown in an unfolded state.
Figure 5:
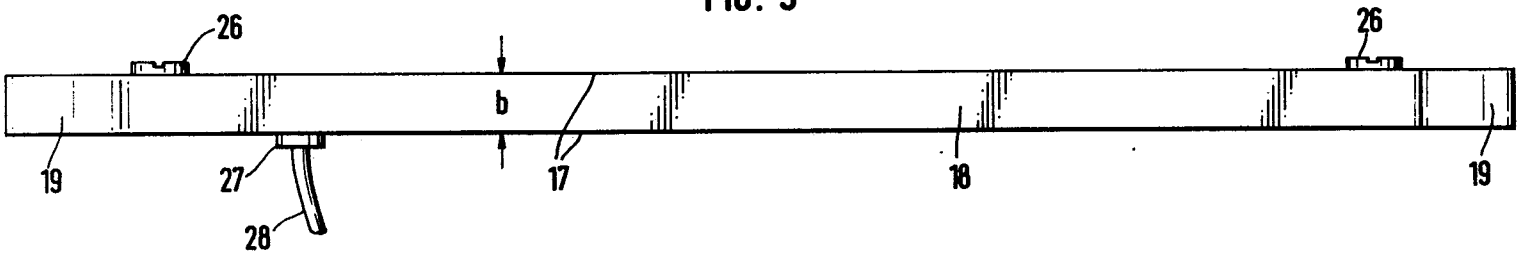
FIG. 5 is the top-view of the band in the direction of the arrow (5) of FIG. 4.

Further details of a preferred design of the air-cushion system may be seen in FIGS. 4 and 5. The air-cushion system comprises two flexible air-tight foils 17 that are interconnected on all sides by means of seams, preferably welding seams. In accordance with the particularly preferred design as shown in FIG. 5, the foils 17 are inter-connected on all sides by means of connecting pieces 18, 19 and 20 which are arranged on all sides and between the two foils 17. The width b extending between the foils 17 should amount to not less than one half, and preferably to 100% of the difference between the inside diameter of the helmet and the diameter of the smallest head size to be fitted, and to no more than three times that difference.

Four throttling passageways are shown as labyrinth-joints, and consist of two welding seams 21 each staggered, but arranged very closely adjacent each other, preferably 5 mm apart of approximately the same width c, and of a length of a few centimeters. These seams 21 separate the two cheek-cushions 22 from the ear-patches 24, and likewise, separate the ear-patches 24 from the neck-cushion 23. The seams 21 extend fully between the side foils 17 so that the passage of air is possible only along the narrow and restricted paths as shown by the arrows 40. In the larger part 24a of the area of the ear-patches 24, the two foils 17 are solidly welded or pasted together, so that that area cannot be inflated, and only narrow passageways 24b for the gas remain between the cheek-cushions 22 and the neckcushion 23. A few welded joints 25 within the area of the neckcushion 23 keep them from being inflated by the same air pressure, similarly to the cheek cushions 22. Numbers 26 are snap-fasteners for attaching the air-cushion system to pocket 6. Number 27 is the valve for inflating the system as well as for letting the air out of the helmet so as to facilitate the removal of the helmet, and 28 is the tube for the air intake.

What is claimed is:

1. A safety helmet comprising an integral helmet, an inflatable, interconnected air-cushion system positioned in a lower part of the integral helmet and an elastic material lining positioned in said integral helment above said air cushion system, said integral helmet having a tapered portion extending in a downward direction below the chin of the wearer and encircling the same, and having a frontal opening for the face, wherein said air cushion system extends from the lower edge of said helmet to at least the level of the ears, but not higher than the level of the temples of a wearer of the safety helmet, said air cushion system including inflatable air cushions substantially free from cellular material having means for inflating and deflating the same, the air cushions, when inflated, contacting the head of the wearer and, when deflated, being spaced from the head of the wearer.

2. A safety helmet, in accordance with claim 1, wherein said air cushion system includes regions that are free of air-cushions.

3. A safety helmet, in accordance with claim 1 wherein said air-cushion system comprises a continuous band of two flexible foils, means for interconnecting said foils in an airtight manner comprising cross-pieces extending between said foils, in such a way that the foils and the cross-pieces form two inflatable cheek cushions and one inflatable neck-cushion, wherein said foils, in the areas between the neck-cushion and the cheek-cushions are inter-connected in such a way so that these areas cannot be inflated, connecting passage-way means between the cheek cushions and the neck cushion, and throttling passageway means positioned between the non-inflatable areas and the inflatable areas.

4. A safety helmet in accordance with claim 3, wherein said throttling passage-way means comprises labyrinth joints having at least two staggered welded or pasted seams.

5. A safety helmet in accordance with claim 3, further comprising welded joint means in the neck-cushion for reducing the thickness when inflated, of the neck cushion from the thickness of the two cheek-cushions.

6. A safety helmet in accordance with claim 3 wherein the width of the cross-pieces is between 50% and 300% of the difference between the inside diameter of the helmet and of the smallest head size to be fitted.

7. A safety helmet as claimed in claim 6, wherein the width of the cross-pieces is equal to 100% of the difference between the inside diameter of the helmet and of the smallest head size to be fitted.

8. A safety helmet in accordance with claim 1, wherein in the region of the chin of a wearer said air cushion system extends upward no further than the edges of the mouth of the wearer, and wherein a cranial region of the helmet is padded with a material such as styropor lined with foam rubber.

9. A safety helmet in accordance with claim 1, wherein said air cushion system is placed inside a pocket, said pocket comprising a relatively rigid foil that is solidly attached to the helmet shell and comprises a hardened PVC-plate, and a soft layer of material welded to said plate, the inside of said soft layer preferably coated with foam material.

10. A safety helmet in accordance with claim 9, wherein said air cushion system is fixedly and detachably connected with the pocket by snap fasteners.

11. A safety helmet in accordance with claim 1, wherein said elastic material lining is a styropor lining positioned above said air cushion system.

12. A safety helmet in accordance with claim 11 further comprising a covering of foamed-plastic tissue in the lower region of the styropor lining above the air-cushion system.

13. A safety helmet comprising an integral helmet, an inflatable, interconnected air-cushion system positioned in a lower part of the integral helmet and an elastic material lining positioned in said integral helmet above said air cushion system, said integral helmet having a tapered portion adapted to extend in a downward direction below the chin of a wearer and encircling the same, and having a frontal opening for a face, wherein said air cushion system extends from the lower edge of said helmet to at least the level of the ears, but not higher than the level of the temples of the wearer of the safety helmet, said air cushion system including inflatable air cushions and control means adapted for connection to a source of air pressure for controlling ingress of pressurized, inflating air into said air cushions thereby adapting the helmet to the head of the wearer, said control means also controlling egress of air from said air cushions to deflate said air cushions thereby facilitating removal of the helmet from the head of the wearer.

14. A safety helmet comprising an integral helmet and an inflatable, interconnected air-cushion system positioned in a lower part of the integral helmet, said integral helmet having a tapered portion extending in a downward direction below the chin of the wearer, and having a frontal opening for the face, wherein said air cushion system extends from the lower edge of said helmet to at least the level of the ears, but not higher than the level of the temples of a wearer of the safety helmet, said air cushion system extending upward no further than the edges of the mouth of the wearer, and wherein a cranial region of the helmet is padded with a material such as styropor lined with foam rubber.

15. A safety helmet comprising an integral helmet, an inflatable, interconnected air-cushion system positioned in a lower part of the integral helmet, and a pocket attached to said helmet for holding said air cushion system, said integral helmet having a tapered portion extending in a downward direction below the chin of the wearer, and having a frontal opening for the face, wherein said air cushion system extends from the lower edge of said helmet to at least the level of the ears, but not higher than the level of the temples of a wearer of the safety helmet, said air cushion system being placed inside said pocket, said pocket comprising a relatively rigid foil that is solidly attached to the helmet shell and comprises a hardened PVC-plate, and a soft layer of material welded to said plate, the inside of said soft layer preferably coated with foam material.

16. A safety helmet comprising an integral helmet, an inflatable, interconnected air-cushion system positioned in a lower part of the integral helmet, and a styropor lining positioned in said integral helmet above said air cushion system, said integral helmet having a tapered portion extending in a downward direction below the chin of the wearer, and having a frontal opening for the face, wherein said air cushion system extends from the lower edge of said helmet to at least the level of the ears, but not higher than the level of the temples of a wearer of the safety helmet.

* * * * *